US011293701B2

(12) United States Patent
Kim et al.

(10) Patent No.: US 11,293,701 B2
(45) Date of Patent: Apr. 5, 2022

(54) HEAT EXCHANGER AND AIR CONDITIONER HAVING THE SAME

(71) Applicant: Samsung Electronics Co., Ltd., Suwon-si (KR)

(72) Inventors: Hyun Young Kim, Yokohama (JP); Seiji Sato, Yokohama (JP); Sang Mu Lee, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 238 days.

(21) Appl. No.: 16/657,703

(22) Filed: Oct. 18, 2019

(65) Prior Publication Data

US 2020/0132395 A1 Apr. 30, 2020

(30) Foreign Application Priority Data

Oct. 18, 2018 (JP) ..... JP2018-196701
Sep. 20, 2019 (KR) ..... 10-2019-0115907

(51) Int. Cl.
*F28F 1/10* (2006.01)
*F28F 1/12* (2006.01)

(52) U.S. Cl.
CPC ..... *F28F 1/128* (2013.01)

(58) Field of Classification Search
CPC .... F28F 1/128; F28F 1/126; F28F 1/14; F28F 1/24; F28F 1/26; F28F 1/32
USPC ..... 165/172, 182
See application file for complete search history.

(56) References Cited

U.S. PATENT DOCUMENTS 1,915,742 A * 6/1933 Mautsch ..... F28F 1/32 165/182
3,645,330 A * 2/1972 Albright ..... F28F 1/32 165/181
3,796,258 A * 3/1974 Malhotra ..... F28F 1/325 29/890.047
4,300,629 A * 11/1981 Hatada ..... F28F 1/325 165/151

(Continued)

FOREIGN PATENT DOCUMENTS

JP H07-17955 Y2 4/1995
JP H07-280479 A 10/1995

(Continued)

OTHER PUBLICATIONS

International Search Report and Written Opinion of the International Searching Authority in connection with International Application No. PCT/KR2019/013691 dated Feb. 19, 2020, 3 pages.

(Continued)

*Primary Examiner* — Claire E Rojohn, III

(57) ABSTRACT

Disclosed herein is a heat exchanger including a corrugated fin and an air conditioner including the same. The corrugated fin includes a through hole through which a heat transfer tube passes, a corrugated portion formed in a zigzag shape in the first direction corresponding to an air flow direction and a flat portion provided in the plane adjacent to the through hole, and the flat portion has a first length in the first direction corresponding to an air flow direction, and a second length shorter than the first length in a second direction perpendicular to the air flow direction.

6 Claims, 11 Drawing Sheets

(56) References Cited

U.S. PATENT DOCUMENTS 4,465,128 A * 8/1984 Krekacs ..... F28F 1/32 165/182
4,691,768 A * 9/1987 Obosu ..... F28F 1/325 165/151
4,705,105 A * 11/1987 Cur ..... F28F 1/325 165/151
4,727,737 A * 3/1988 Bryant ..... B21D 7/024 72/153
4,923,002 A * 5/1990 Haussmann ..... F28F 1/32 165/182
5,056,594 A * 10/1991 Kraay ..... F28F 1/325 165/181
5,203,403 A * 4/1993 Yokoyama ..... F28F 1/32 165/182
5,207,270 A * 5/1993 Yokoyama ..... F28F 1/325 165/182
5,775,413 A * 7/1998 Kawanabe ..... F28F 1/32 165/181
5,927,393 A * 7/1999 Richter ..... F28F 1/32 165/182
6,889,759 B2 * 5/2005 Derosier ..... F28F 1/32 165/181
7,021,370 B2 * 4/2006 Papapanu ..... F28F 1/325 62/515
8,613,307 B2 * 12/2013 Kim ..... F28F 17/005 165/181
D700,689 S * 3/2014 Obosu ..... D23/323
9,952,002 B2 * 4/2018 Wada ..... F28D 1/0477
10,914,530 B2 * 2/2021 Etienne ..... F28F 1/325
2004/0251016 A1 * 12/2004 Oh ..... F28F 1/32 165/172
2005/0045316 A1 * 3/2005 Oh ..... F28F 1/32 165/150
2005/0056407 A1 * 3/2005 Oh ..... F28F 1/32 165/151
2008/0190588 A1 * 8/2008 Heidenreich ..... F28F 1/325 165/181
2009/0199585 A1 8/2009 Ogawa et al.
2011/0120681 A1 * 5/2011 Seo ..... F24F 1/0067 165/151
2012/0267072 A1 10/2012 Park et al.
2016/0054065 A1 * 2/2016 Nagai ..... F28F 1/325 165/151
2016/0123681 A1 5/2016 Honma et al.
2020/0096206 A1 * 3/2020 Kim ..... F24F 1/0067
2021/0325127 A1 * 10/2021 Feng ..... F28D 1/0477

FOREIGN PATENT DOCUMENTS

JP 2004-085013 A 3/2004
JP 2013221682 A 10/2013

OTHER PUBLICATIONS

Supplementary European Search Report dated Oct. 8, 2021, in connection with European Application No. 19874628.1, 6 pages.

* cited by examiner

FIG. 5

| | CIRCULAR SHAPE | OVAL TYPE SHAPE #1 | OVAL TYPE SHAPE #2 | OVAL TYPE SHAPE #3 | OVAL TYPE SHAPE #4 |
|---|---|---|---|---|---|
| SHEET PORTION SIZE (VL x HL) | 8.5 x 8.5 | 8.5 x 10.5 | 8.5 x 12.5 | 8.5 x 14.5 | 8.5 x 16.5 |
| FIRST LENGTH/ FIN WIDTH (HL/RP) | 0.47 | 0.58 | 0.69 | 0.8 | 0.91 |
| HEAT EXCHANGE EFFICIENCY/ AIR RESISTANCE | 100.00 | 100.14 | 100.14 | 100.17 | 100.09 |

HEAT EXCHANGER AND AIR CONDITIONER HAVING THE SAME

CROSS-REFERENCE TO RELATED APPLICATIONS

This application is based on and claims priority under 35 U.S.C. 119 to Korean Patent Application No. 10-2019-0115907, filed on Sep. 20, 2019, in the Korean Intellectual Property Office, which claims the benefit of Japanese Patent Application No. 2018-196701 filed on Oct. 18, 2018, in the Japan Patent Office, the disclosures of which are herein incorporated by reference in their entireties.

BACKGROUND

1. Field

The disclosure relates to a heat exchanger capable of exchanging heat between a refrigerant and air, and an air conditioner including the same.

2. Description of Related Art

In general, an air conditioner includes an indoor heat exchanger that exchanges heat with indoor air, and an outdoor heat exchanger that exchanges heat with outdoor air.

The indoor heat exchanger and the outdoor heat exchanger include heat transfer tubes through which a refrigerant passes, and fins, through which the heat transfer tubes pass, to increase an area on which heat exchange with air is performed.

Recently, a heat exchanger having improved performance has been disclosed, and the heat exchanger employs a corrugated fin formed by being folded to have a corrugated shape so as to effectively perform heat exchange between the refrigerant and air, thereby improving the performance.

SUMMARY

Therefore, it is an aspect of the disclosure to provide a heat exchanger capable of improving a performance by allowing a flat portion of a fin, adjacent to a through hole, on which a heat transfer tube is installed, to be in contact with more air.

Additional aspects of the disclosure will be set forth in part in the description which follows and, in part, will be obvious from the description, or may be learned by practice of the disclosure.

In accordance with an aspect of the disclosure, a heat exchanger includes a heat transfer tube configured to guide a refrigerant, and a plurality of corrugated fins provided with a through hole through which the heat transfer tube is installed to pass, and spaced apart from each other to allow air to pass in a first direction, and the corrugated fin includes a corrugated portion formed in a zigzag shape in the first direction corresponding to an air flow direction and a flat portion provided as a flat surface in the vicinity of the through hole, and the flat portion has a first length in the first direction corresponding to the air flow direction, and a second length shorter than the first length, in a second direction perpendicular to the air flow direction.

The corrugated fin may include a collar in surface contact with the heat transfer tube and a sheet portion provided in the vicinity of the through hole so as to form the collar, and the sheet portion may form the flat portion.

The flat portion may be formed by a first arc passing through a first point corresponding to one end of the first direction and a tangent line thereof, a second arc passing through a second point corresponding to the other end of the first direction and a tangent line thereof, a third arc passing through a third point corresponding to one end of the second direction and a tangent line thereof, and a fourth arc passing through a fourth point corresponding to the other end of the second direction and a tangent line thereof.

A center of curvature of the first arc and a center of curvature of the second arc may be symmetrically positioned in the first direction with respect to the center of the heat transfer tube.

A center of curvature of the third arc and a center of curvature of the fourth arc may be symmetrically positioned in the second direction with respect to the center of the heat transfer tube.

The first arc and the second arc may have a first radius of curvature, and the third arc and the fourth arc may have a second radius of curvature greater than the first radius of curvature.

The flat portion may be formed in the oval shape in which two focal points are symmetrically positioned in the first direction with respect to the center of the heat transfer tube.

A ratio of the first length of the corrugated fin to a width of the corrugated fin in the first direction may be in a range from about 0.6 to about 0.85.

The corrugated fin may include a plurality of inclined portions connected in a zigzag shape and inclined with respect to the first direction, and louvers formed by cutting and bending a portion of the plurality of inclined portions.

The corrugated fin may include four inclined portions connected in a zigzag shape, and the louvers may be formed on any one of two inclined portions located on the outside and two inclined portions located on the inside among the four inclined portions.

The heat exchanger may further include a connecting portion configured to connect the corrugated portion to the flat portion.

The corrugated portion may include two ridges and one valley formed on four inclined portions, and the center of the heat transfer tube may be placed at a position corresponding to the valley, and the connecting portion may be arranged in a region except the valley.

In accordance with another aspect of the disclosure, an air conditioner includes an indoor heat exchanger configured to exchange heat with indoor air and an outdoor heat exchanger configured to exchange heat with outdoor air, and at least one of the outdoor heat exchanger or at least one of the indoor heat exchanger include a heat transfer tube configured to guide a refrigerant, and a plurality of corrugated fins provided with a through hole through which the heat transfer tube is installed to pass, and spaced apart from each other to allow air to pass in a first direction, and the corrugated fin includes a corrugated portion formed in a zigzag shape in the first direction corresponding to an air flow direction, and a flat portion provided as a flat surface in the vicinity of the through hole, and the flat portion has a first length in the first direction corresponding to the air flow direction, and a second length shorter than the first length, in a second direction perpendicular to the air flow direction.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of embodiments, taken in conjunction with the accompanying drawings of which:

FIG. 5 is a table illustrating data evaluated for the effects of a first length HL of the sheet portion in a first direction corresponding to an air flow direction, on the performance;

DETAILED DESCRIPTION

Figure 1:
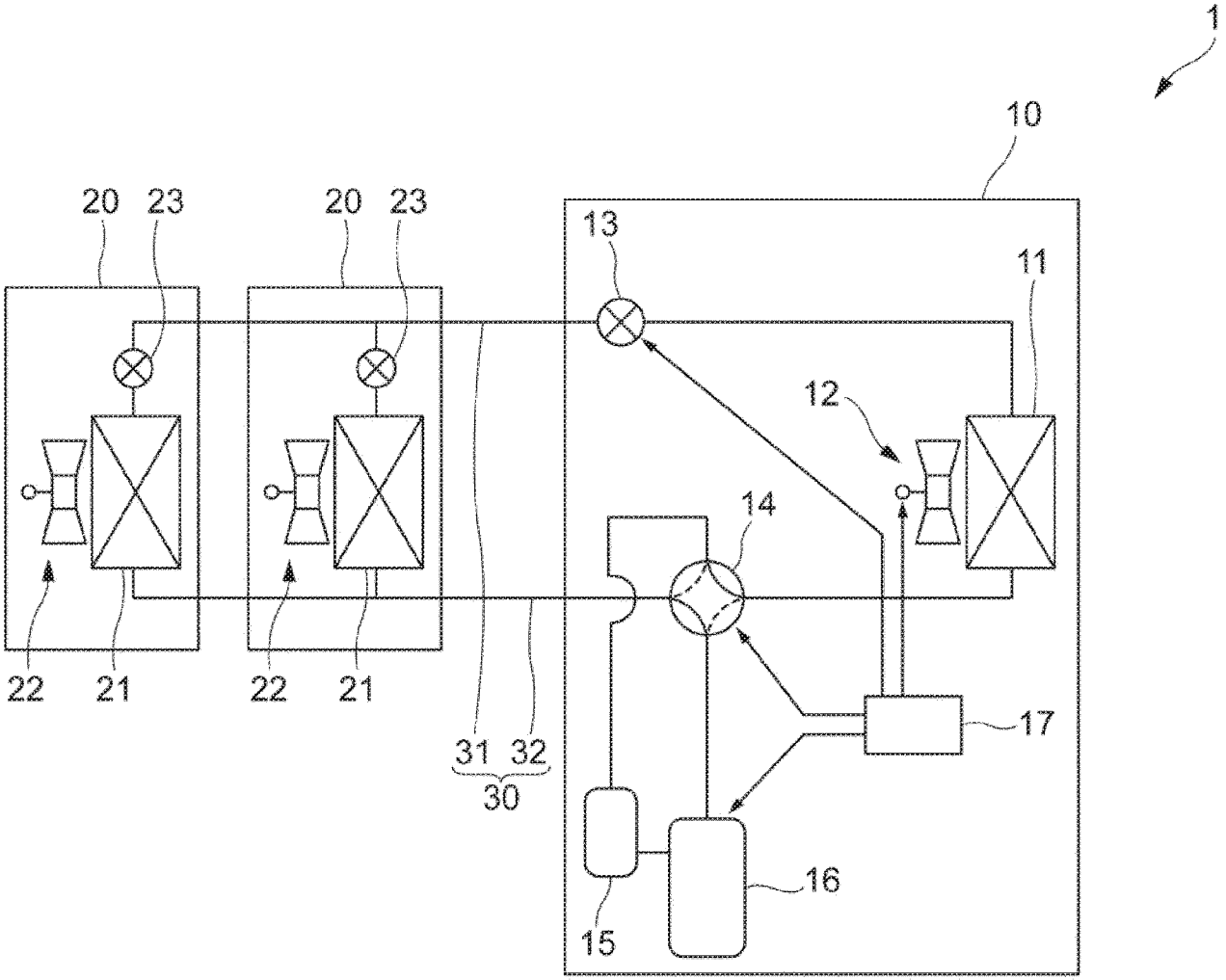
FIG. 1 illustrates a schematic diagram of an air conditioner according to an embodiment of the disclosure.

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front end", "rear end", "upper portion", "lower portion", "upper end", "lower end" and the like may be defined by the drawings, but the shape and the location of the component is not limited by the term.

FIG. 1 illustrates a schematic diagram of an air conditioner according to an embodiment of the disclosure and a view illustrating a heating operation is performed.

As illustrated in FIG. 1, an air conditioner includes an outdoor unit 10 arranged in an outdoor space, a plurality of indoor units 20 installed in an indoor space, and refrigerant pipes 31 and 32 configured to connect the outdoor unit 10 to the plurality of indoor units 20 so as to circulate a refrigerant between the outdoor unit 10 and the plurality of indoor units 20.

According to the embodiment, two indoor units 20 are connected to a single outdoor unit 10, but this is only an example and is not limited thereto. That is, a single indoor unit 20 may be connected to a single outdoor unit 10, or three or more indoor units 20 may be connected to a single outdoor unit 10.

The outdoor unit 10 includes an outdoor heat exchanger 11 configured to exchange heat between outdoor air and a refrigerant, an outdoor blower 12 configured to allow the outdoor air to pass through the outdoor heat exchanger 11, a compressor 16 configured to compress a refrigerant, a four-way valve 14 configured to guide the refrigerant discharged from the compressor 16 to one of the outdoor unit 10 and the indoor unit 20, an outdoor expansion valve 13 configured to decompress and expand the refrigerant, and an accumulator 15 configured to separate a liquid refrigerant from the refrigerant flowing to the compressor 16 and configured to allow the liquid refrigerant to be vaporized and to flow into the compressor 16.

The outdoor unit 10 also includes a controller 17 configured to control the operation of the outdoor blower 12, the outdoor expansion valve 13, the compressor 16, and the four-way valve 14. The controller 17 may be constituted by a microcomputer.

The indoor unit 20 includes an indoor heat exchanger 21 configured to exchange heat between indoor air and a refrigerant, an indoor blower 22 configured to allow the indoor air to pass through the indoor heat exchanger 21, and an indoor expansion valve 23 configured to decompress and expand the refrigerant.

The refrigerant pipe 30 includes a liquid refrigerant pipe 31 through which a liquid refrigerant passes, and a gaseous refrigerant pipe 32 through which a gaseous refrigerant passes. The liquid refrigerant pipe 31 allows the refrigerant to flow between the indoor expansion valve 23 and the outdoor expansion valve 13. The gaseous refrigerant pipe 32 guides the refrigerant to move between the four-way valve 14 of the outdoor unit 10 and the gas side of the indoor heat exchanger 21 of the indoor unit 20.

Any one of a single HC refrigerant, a mixed refrigerant including HC, R32, R410A, R407C, or carbon dioxide may be used as the refrigerant used in the air conditioner.

Figure 2:
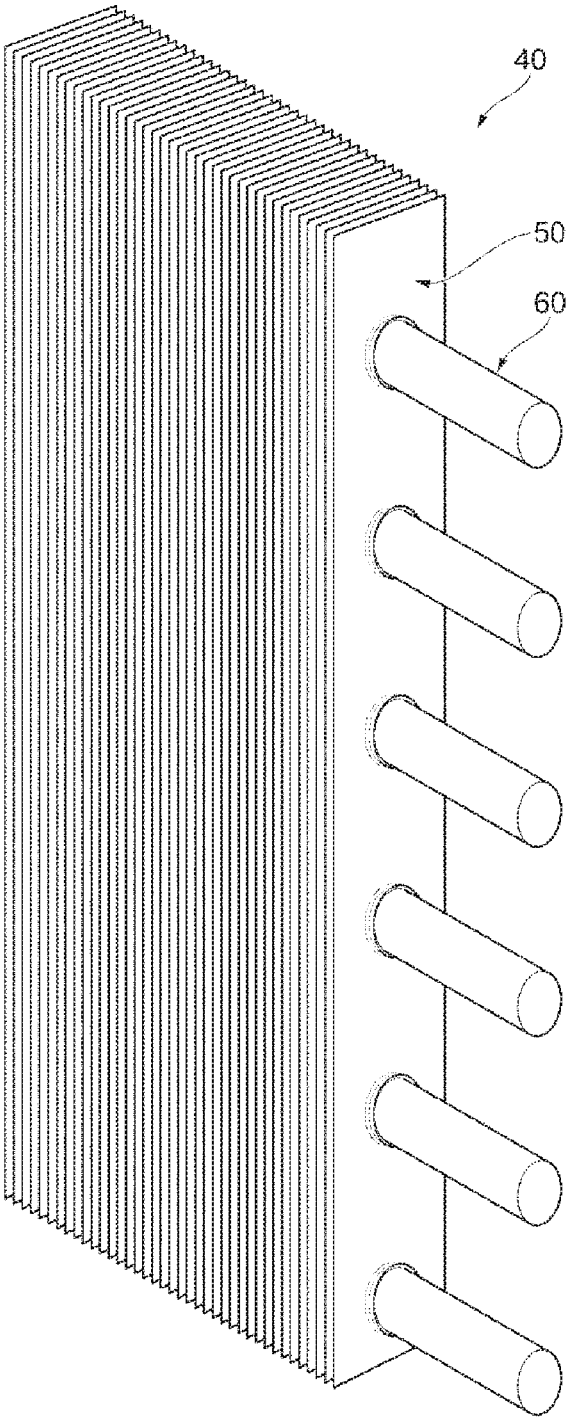
FIG. 2 illustrates a perspective view of a heat exchanger according to an embodiment of the disclosure.

FIG. 2 illustrates a perspective view of the heat exchanger 40 according to an embodiment of the disclosure.

As illustrated in FIG. 2, the heat exchanger 40 corresponds to at least one of the outdoor heat exchanger 11 and the indoor heat exchanger 21 shown in FIG. 1.

The heat exchanger 40 is a fin tube type heat exchanger, and includes a plurality of fins 50 formed of aluminum and a heat transfer tube 60 having a circular cross section formed of copper or aluminum.

The plurality of fins 50 are arranged perpendicular to the heat transfer tube and spaced apart from each other so that air passes between the plurality of fins 50 in a first direction. The heat transfer tube 60 is installed to pass through the through holes provided in each of the fins 50 and arranged in parallel with each other. The heat transfer tube 60 is connected to the refrigerant pipes 30 of the air conditioner of FIG. 1 to form a closed loop refrigeration cycle.

In addition, because the heat transfer tube 60 is in contact with the fin 50 to transfer heat or receive heat through the fin 50, a contact area with the air passing through the heat exchanger 40 is increased through the fin 50. Therefore, heat exchange between the refrigerant passing through the heat transfer tube 60 and the refrigerant passing through the heat exchanger 40 is efficiently performed through the fin 50.

In order to effectively perform the heat transfer between the fin 50 and the air, the fin 50 may have a corrugated form formed in such a way that the fin 50 is bent in a zigzag shape through the press die, in a first direction corresponding to an air flow direction. Hereinafter the fin 50, in which the corrugated form is formed, as described above is referred to as a corrugated fin 80.

The corrugated fin 80 includes a collar 84 in surface contact with the heat transfer tube 60, and a sheet portion 85 provided as a flat surface around the collar 84 to form the collar 84. The sheet portion 85 is adjacent to the collar 84 in contact with the heat transfer tube 60 and thus the sheet portion 85 has a temperature similar to that of the refrigerant passing through the heat transfer tube 60.

Therefore, heat exchange between the refrigerant and the air may be efficiently performed in the sheet portion 85, and thus, more air may be in contact with the sheet portion 85, thereby improving the heat exchange efficiency of the heat exchanger 40.

Figure 3:
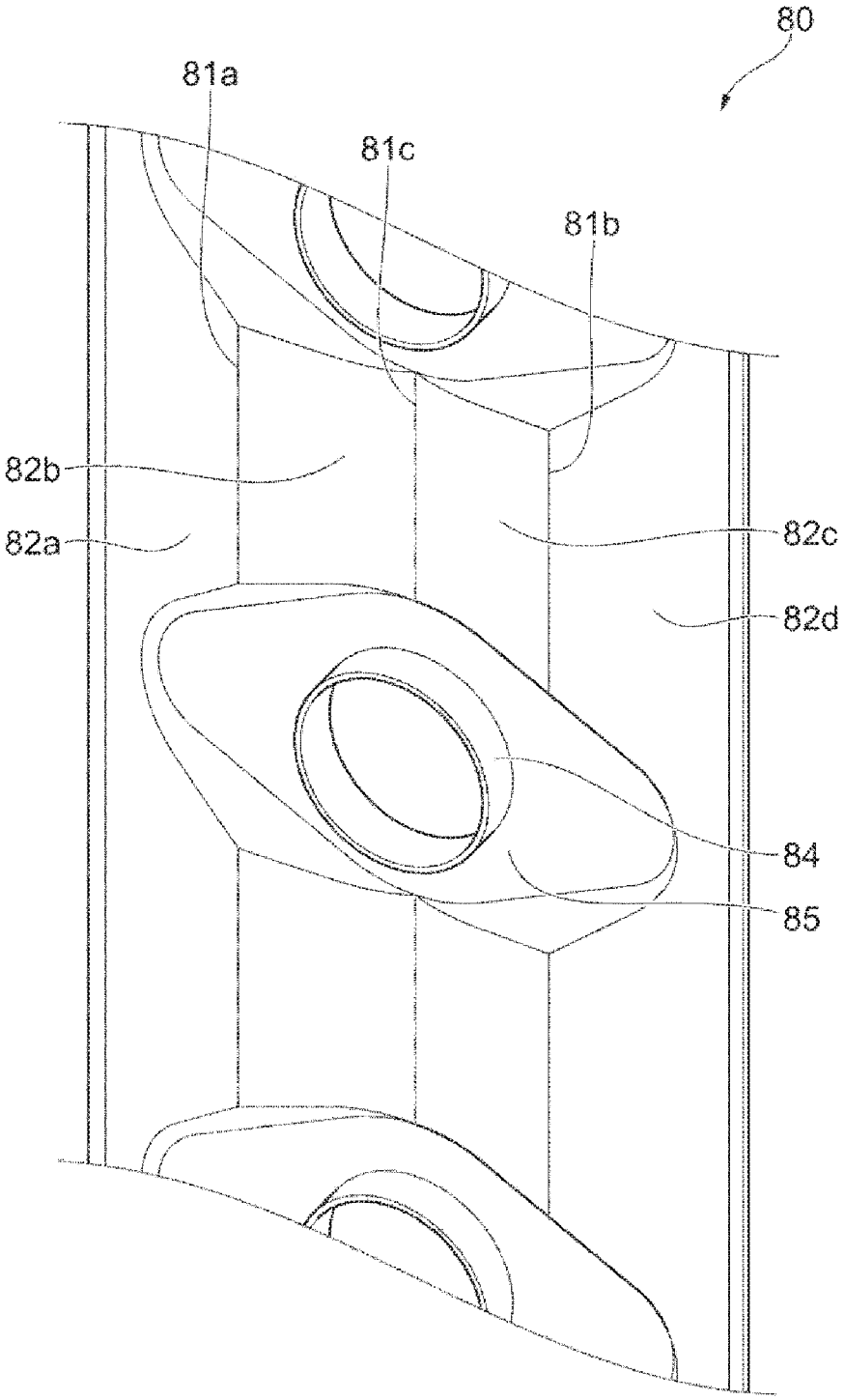
FIG. 3 illustrates an enlarged-perspective view of a part of a corrugated fin according to an embodiment of the disclosure.

FIG. 3 illustrates an enlarged-perspective view of a part of the corrugated fin 80 according to n embodiment of the disclosure.

As illustrated in FIG. 3, the sheet portion 85 is formed to have a first length in the first direction corresponding to the air flow direction, and have a second length that is shorter than the first length in a second direction that is perpendicular to the first direction. The heat exchange efficiency of the heat exchanger 40 may be improved by allowing more air to be in contact with the sheet portion 85.

According to the embodiment, the sheet portion 85 is formed in an oval type shape extending in the first direction corresponding to the air flow direction.

The corrugated fin 80 includes four inclined portions 82*a*, 82*b*, 82*c*, and 82*d*, two ridges 81*a* and 81*b* and one valley 81*c* formed by the four inclined portions. The four inclined portions 82*a*, 82*b*, 82*c*, and 82*d* include the inclined portion 82*a* positioned on the left side of the left ridge 81*a* according to the drawings, the inclined portions 82*b* and 82*c* positioned between the two ridges 81*a* and 81*b*, and the valley 81*c*, and the inclined portion 82*d* positioned on the right side of the right ridge 81*b* according to the drawings. The ridges 81*a* and 81*b*, and the valley 81*c* correspond to folded parts that is generated when the corrugated fin 80 is bent to form the inclined portions 82*a*, 82*b*, 82*c*, and 82*d*. The inclined portions 82*a*, 82*b*, 82*c*, and 82*d* are inclined surfaces inclined with respect to a surface of the fin 50 having a shape in a state before the inclined portions 82*a*, 82*b*, 82*c*, and 82*d* are formed. Therefore, the corrugated fin 80 includes the ridges 81*a* and 81*b*, and the valley 81*c*, and the inclined portions 82*a*, 82*b*, 82*c*, and 82*d* connected to each other in a zigzag shape through the ridges 81*a* and 81*b*, and the valley 81*c*. Therefore, the corrugated portion having the zigzag shape is formed by the ridges 81*a* and 81*b*, and the valley 81*c*, and the inclined portions 82*a*, 82*b*, 82*c*, and 82*d*. A flat portion having a flat shape is formed by the sheet portion 85.

Figure 4:
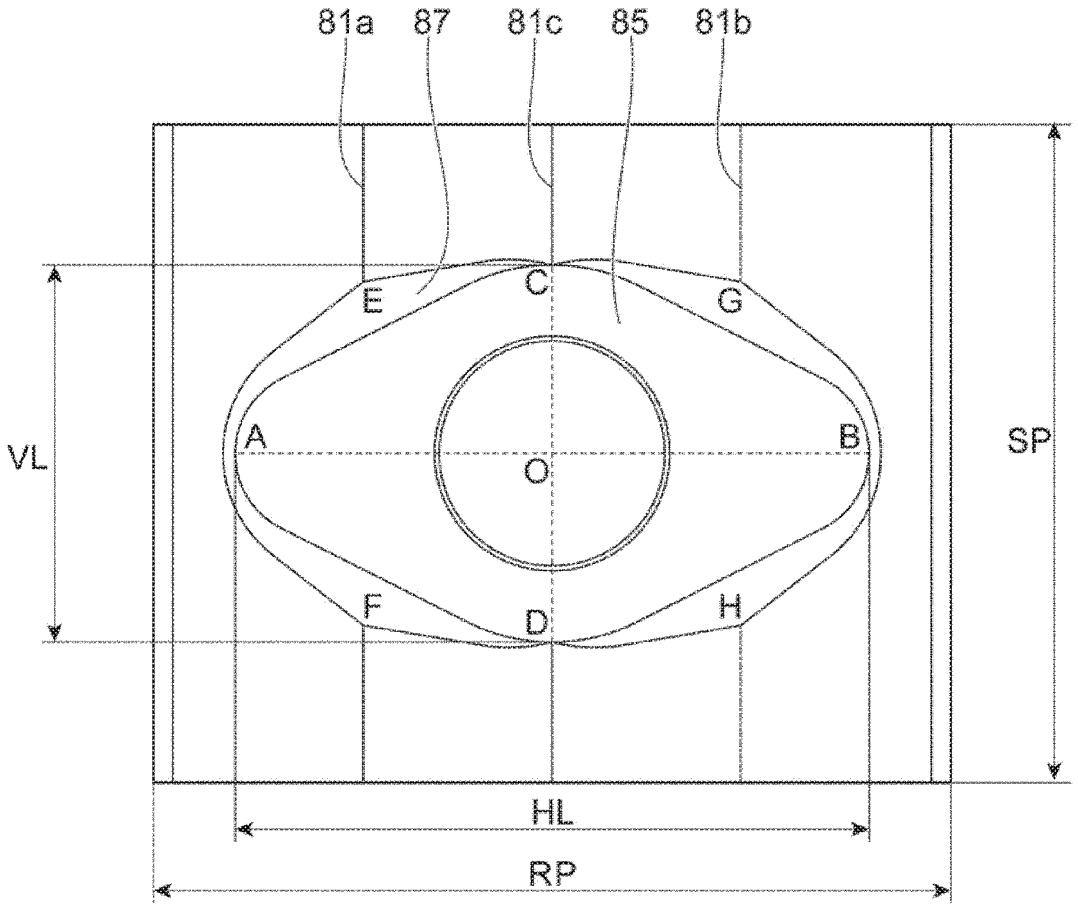
FIG. 4 illustrates a side view of a sheet portion according to an embodiment of the disclosure.

FIG. 4 illustrates the sheet portion 85. A width of the corrugated fin 80 (hereinafter referred to as "fin width") is referred to as RP, and a distance between the heat transfer tubes 60 is referred to as SP. The sheet portion 85 has a first length HL in the first direction (left and right direction in the drawing) corresponding to the air flow direction, and a second length VL in the second direction (up and down direction in the drawing) which is perpendicular to the first direction corresponding to the air flow direction. When opposite ends of the first direction in the sheet portion 85 are referred to as points A and B, the points A and B are provided at positions symmetric in the first direction with respect to center O of the heat transfer tube 60. In addition, when opposite ends of the second direction in the sheet portion 85 are referred to as points C and D, the points C and D are provided at positions symmetric in the second direction with respect to the center O of the heat transfer tube 60. Therefore, a distance between the point A and the point B is the first length HL mentioned above, and a distance between the point C and the point D is the second length VL mentioned above. The center O of the heat transfer tube 60 is located at a position corresponding to the valley 81*c*.

"Oval type shape" refers to a shape having a shape similar to an oval shape formed in such a way that a first length in the first direction corresponding to the air flow direction is greater than a second length in the second direction perpendicular to the air flow direction. According to the embodiment, the sheet portion 85 has an approximately oval type shape formed by a first arc passing through the point A on the left side and a tangent line thereof, a second arc passing through the point B on the right side and a tangent line thereof, a third arc passing through the point C on the upper side and a tangent line thereof, and a fourth arc passing through the point D on a lower side and a tangent line thereof.

It is appropriate that the first and second arcs have a center of curvature on a straight line connecting the point A, the center O of the heat transfer tube 60 and the point B, and the third and fourth arcs have a center of curvature on a straight line connecting the point C, the center O of the heat transfer tube 60 and the point D, but is not limited thereto.

As for the sheet portion 85 having the oval type shape, the first and second arcs have a radius of curvature R1 and the third and fourth arcs have a radius of curvature R2 greater than R1, but are not limited thereto. Therefore, the sheet portion 85 may be formed in various oval type shapes in which the first length HL is longer than the second length VL.

The corrugated fin 80 includes a connecting portion 87 connecting the corrugated portion to the flat portion. The connecting portion 87 connects between the ridges 81*a* and 81*b* and the valley 81*c* forming the corrugated portion, and the sheet portion 85 forming the flat portion. The connecting portion 87 is formed to surround the sheet portion 85 but is not formed in the valley 81*c*. Vertices E and F of the connecting portion 87 are formed in the ridge 81*a* and vertices G and H of the connecting portion 87 are formed in the ridge 81*b*.

Therefore, because condensed water generated in the heat exchanger 40 may be easily moved along the valley 81*c*, the condensed water is prevented from being collected in the sheet portion 85, thereby preventing the increase in the air resistance in the sheet portion 85.

FIG. 5 illustrates data for showing the effect of the first length HL of the sheet portion 85 on the heat exchange performance of the sheet portion 85.

FIG. 5 illustrates the heat exchange efficiency/air resistance value for various sheet portions including the sheet portion 85 having a circular shape in which a second length VL is fixed at 8.5 mm and a first length HL is 8.5 mm, and the sheet portions 85 having various oval type shapes 41 to 44 in which a second length VL, is fixed at 8.5 mm and a first length HL is gradually increased. When it is assumed that the heat exchange efficiency/air resistance of the sheet portion 85 having a circular shape is 100, the heat exchange efficiency/air resistance value is expressed by a relative value of the heat exchange efficiency/air resistance of the sheet portion 85 having the oval shapes #1 to #4 with respect to the heat exchange efficiency/air resistance of the sheet portion 85 having the circular shape.

Figure 6:
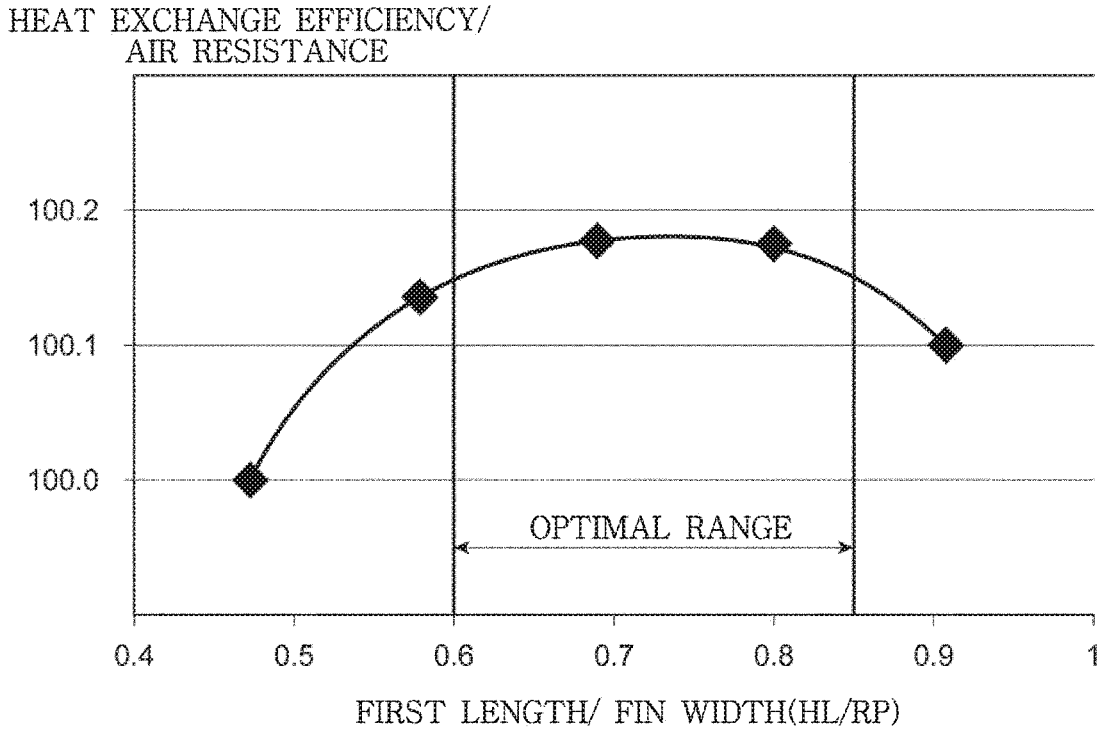
FIG. 6 is a graph illustrating results according to FIG. 5.

FIG. 6 is a graph illustrating the evaluation results of the above. It can be seen from the graph of FIG. 6 that the heat exchange efficiency/air resistance value becomes optimal when a ratio of the first length HL to the fin width RP of the sheet portion 85 is in a range of from about 0.6 to about 0.85.

As mentioned above, by allowing the ratio of the first length HL of the sheet portion 85 to the fin width RP to be the range of 0.6 to 0.85, it is possible to improve the heat exchange performance per air resistance value.

Further, by lengthening the sheet portion 85 in the first direction corresponding to the air flow direction, the bending strength of the corrugated fin 80 may be sufficiently secured.

Hereinafter securing the bending strength of the corrugated fin 80 will be described.

As illustrated in FIG. 2, the heat exchanger 40 is manufactured to be elongated in one direction and then bent to be placed in the outdoor unit 10 or the indoor unit 20.

Figure 7:
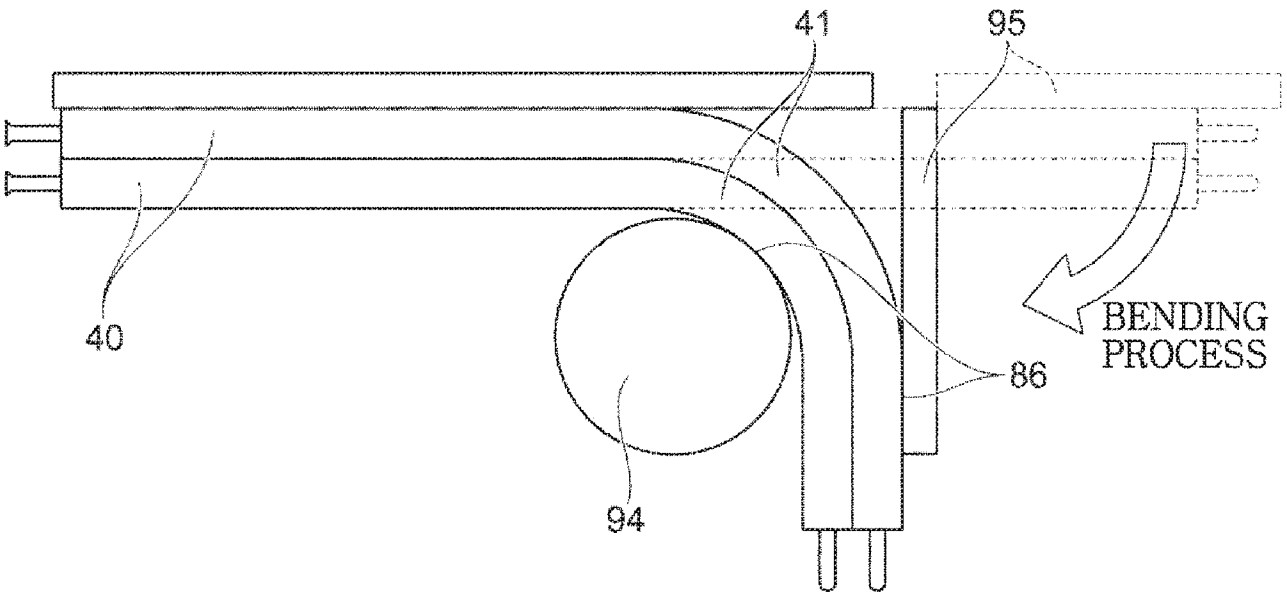
FIG. 7 is a plan view illustrating a case in which two heat exchangers of FIG. 2 are arranged in parallel and a bending process is performed thereon.

FIG. 7 is a plan view of the heat exchanger 40 and illustrates a case in which two straight heat exchangers 40 extending in one direction are arranged in parallel and then bent.

When the bending process is performed on the heat exchanger 40, one end 86 of the corrugated tin 80 is in contact with a roller 94 or a die 95 and receives a force. Therefore, it is beneficial that the corrugated fin 80 has a sufficient bending strength. When the bending strength of the corrugated fin 80 is low, an adjacent portion of the one end 86 of the corrugated fin 80 in contact with the roller 94 or the die 95 may be deformed during the bending process of the heat exchanger 40. A bent portion of the corrugated fin 80 interferes with the flow of air, so resistance of the flow path is increased and the performance of the heat exchanger 40 is reduced.

Figure 8:
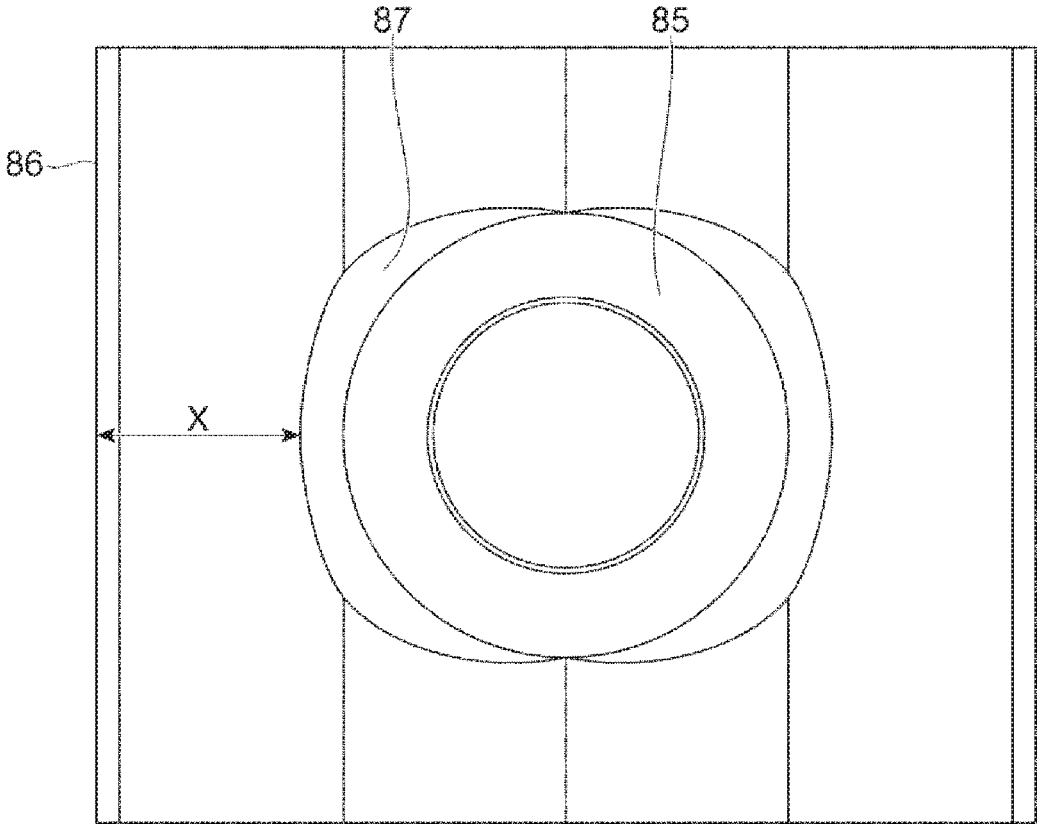
FIG. 8 is a side view of a sheet portion illustrating a bending strength when the sheet portion has a circular shape.
Figure 9:
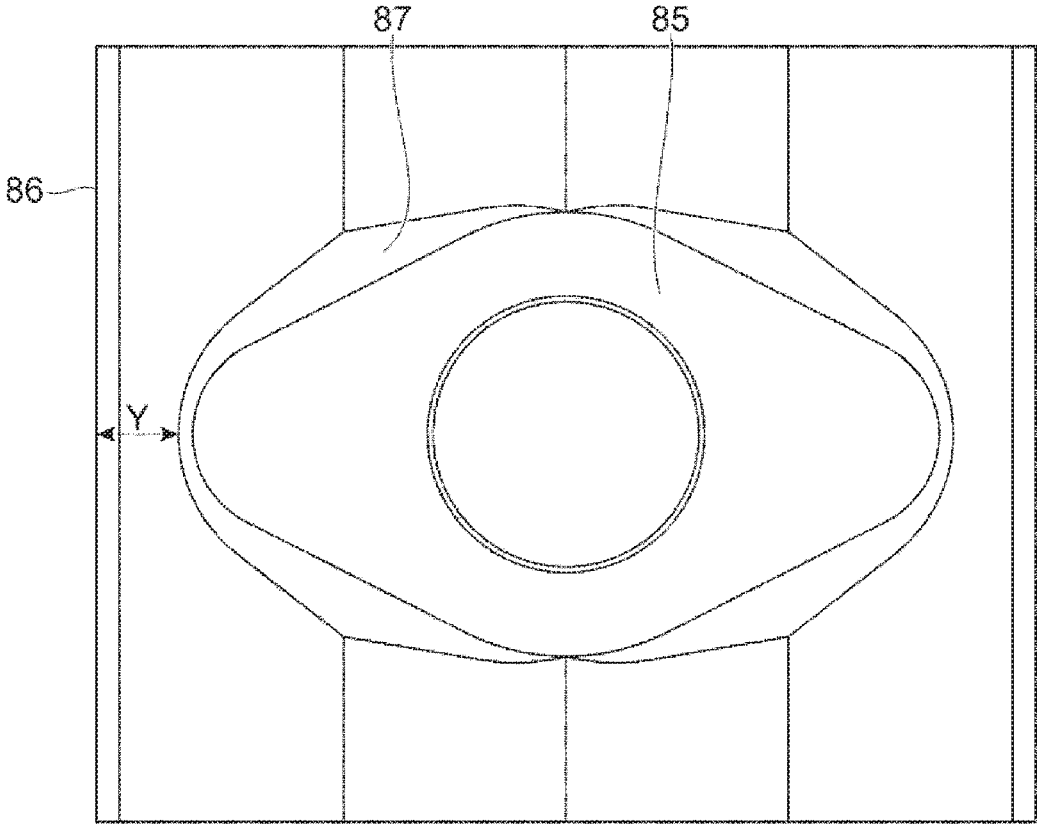
FIG. 9 is a side view of a sheet portion illustrating a bending strength when the sheet portion has an oval shape.

FIGS. 8 and 9 are views illustrating the bending strength. FIG. 8 illustrates the case where the sheet portion 85 is in the circular shape, and FIG. 9 illustrates the case where the sheet portion 85 is in the oval type shape. The bending strength of the corrugated fin 80 is increased by the connecting portion 87. Because a portion to which a force is applied by the roller 94 is the one end 86 of the corrugated fin 80, the bending strength of the corrugated fin 80 is increased as a distance between the one end of the corrugated fin 80 and the connecting portion 87 is reduced. That is, because a distance Y when the sheet portion 85 is formed in the oval type shape as shown in FIG. 9 is less than a distance X when the sheet portion 85 is formed in the circular shape as shown in FIG. 8, the bending strength of the corrugated fin 80 shown in FIG. 9 is high.

Accordingly, because the bending strength of the corrugated fin 80 is fully secured by the sheet portion 85 and the connecting portion 87, it is possible to easily perform the bending process on the heat exchanger 40. In addition, as described above, it is possible to by sufficiently secure the bending strength of the corrugated fin 80 and thus it is possible to form the corrugated fin 80 having a shape that is suitable for the air flow, thereby generating the effective air flow.

In FIG. 3, the inclined portions 82*a*, 82*b*, 82*c*, and 82*d* may be formed in a flat plate shape without any separate configuration, but is not limited thereto.

Figure 10:
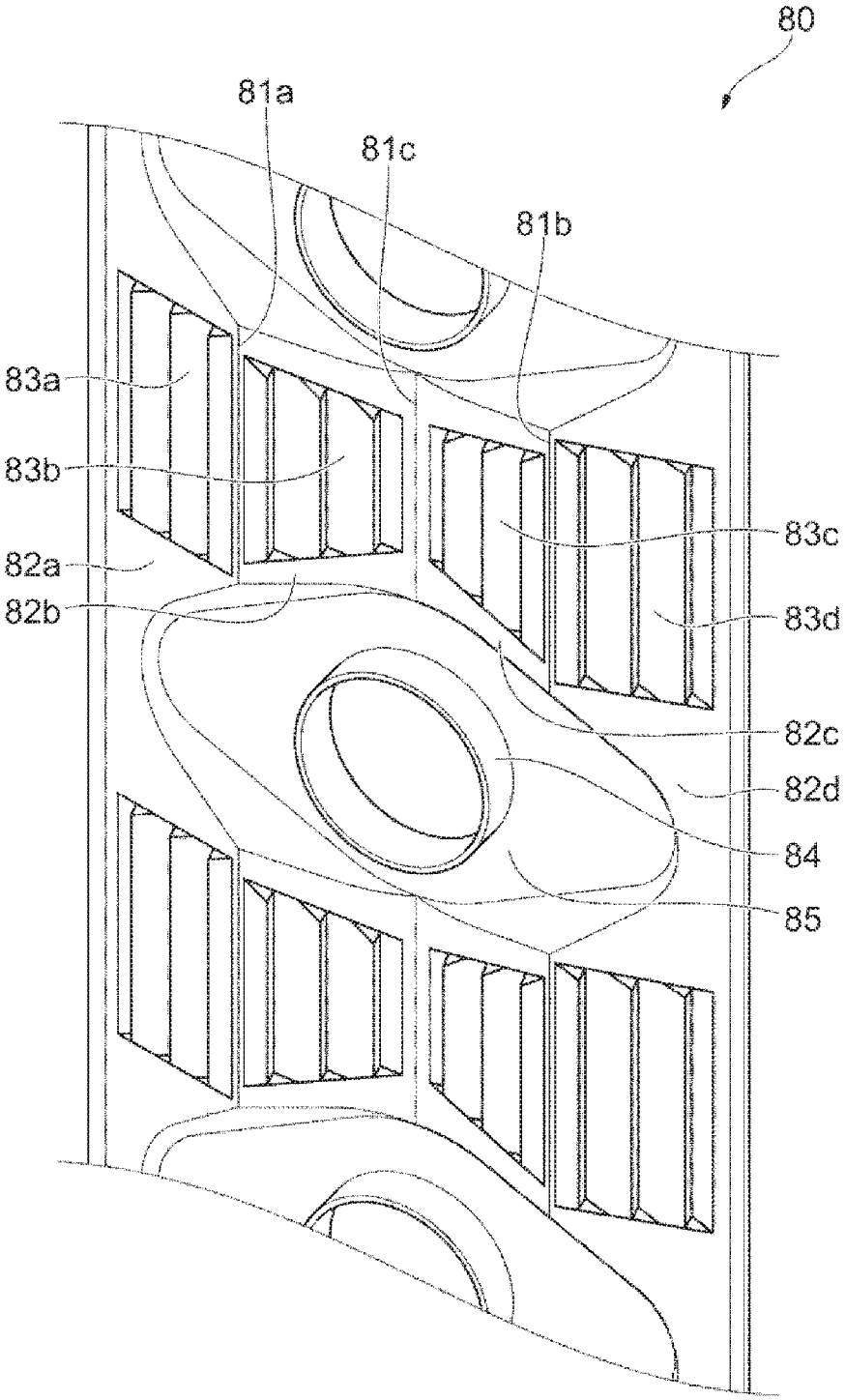
FIG. 10 illustrates perspective view of a corrugated fin according to an embodiment of the disclosure.

FIG. 10 illustrates a perspective view of a corrugated fin 80 according to another embodiment of the disclosure.

As illustrated in FIG. 10, a corrugated fin 80 includes ridges 81*a* and 81*b* and a valley 81*c*, an inclined portion 82*a* positioned on the left side of the left ridge 81*a* according to the drawing, inclined portions 82*b* and 82*c* between the ridges 81*a* and 81*b* and the valley 81*c*, and an inclined portion 82*d* positioned on the right side of the right ridge 81*b* according to the drawings, so as to have a corrugated portion by the ridges 81*a* and 81*b*, the valley 81*c* and the inclined portions 82*a*, 82*b*, 82*c*, and 82*d*.

The corrugated fin 80 includes a collar 84 in surface contact with a heat transfer tube 60, and a sheet portion 85 forming the collar 84, and particularly the sheet portion 85 corresponds to a flat portion.

Louvers 83*a*, 83*b*, 83*c*, 83*d* are formed in the inclined portions 82*a*, 82*b*, and 82*d*, respectively.

Figure 11:
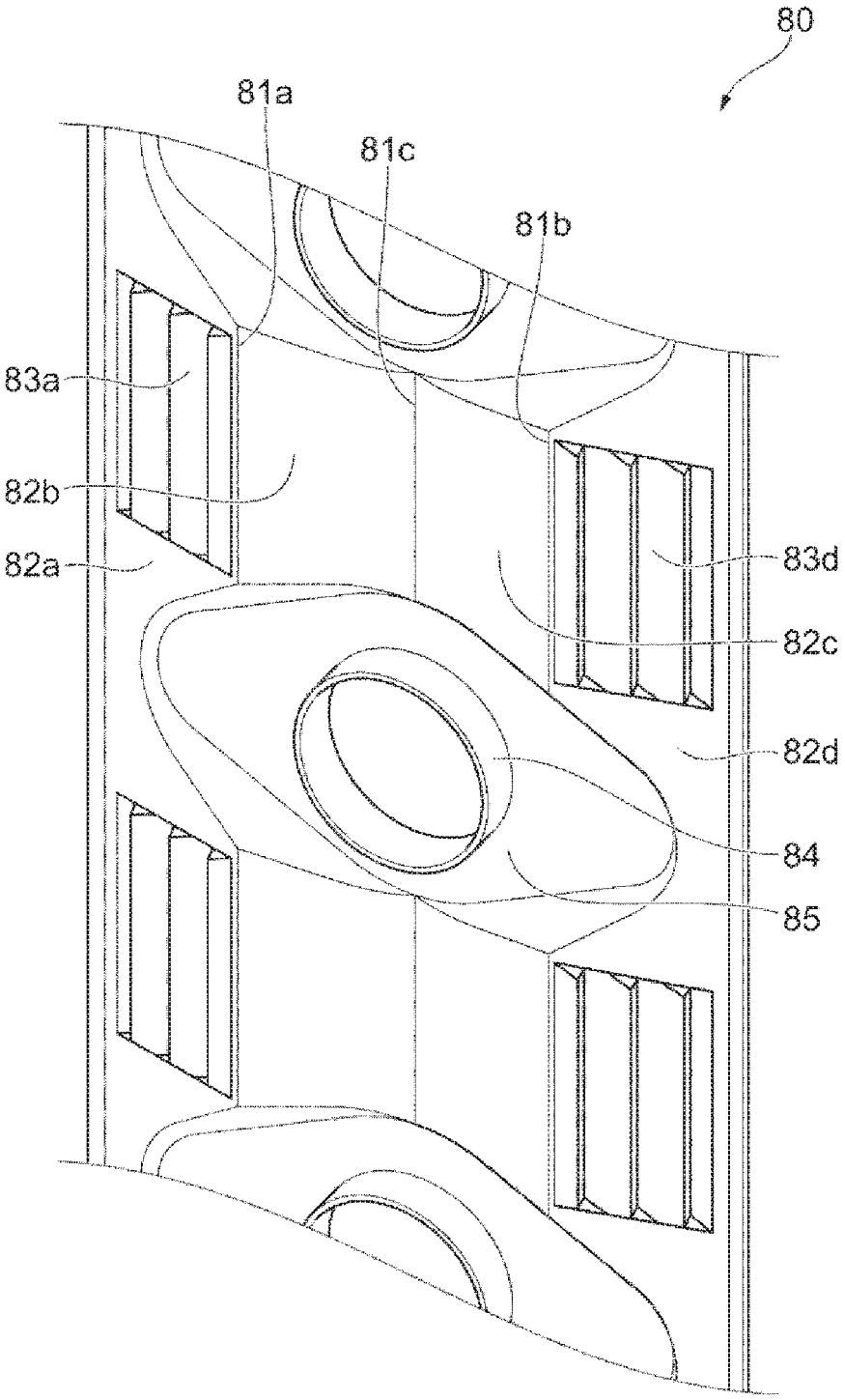
FIG. 11 is perspective view of a corrugated fin according to an embodiment of the disclosure.

In FIG. 10, the louvers 83*a*, 83*b*, 83*c*, and 83*d* are formed in all the inclined portions 82*a*, 82*b*, 82*c*, and 82*d* of the corrugated fin 80, but are not limited thereto. As illustrated in FIG. 11 according to an embodiment of the disclosure, louvers 83*a* and 83*d* may be formed on inclined portions 82*a* and 82*d* among inclined portions 82*a*, 82*b*, 82*c*, and 82*d*.

FIG. 11 illustrates perspective view of a corrugated fin 80 according to an embodiment of the disclosure.

As illustrated in FIG. 11, a corrugated fin 80 includes ridges 81*a* and 81*b* and a valley 81*c*, an inclined portion 82*a* positioned on the left side of the left ridge 81*a* according to the drawing, inclined portions 82*b* and 82*c* between the ridges 81*a* and 81*b* and the valley 81*c*, and an inclined portion 82*d* positioned on the right side of the right ridge 81*b* according to the drawings, so as to have a corrugated portion by the ridges 81*a* and 81*b* the valley 81*c* and the inclined portions 82*a*, 82*b*, 82*c*, and 82*d*.

The corrugated fin 80 includes a collar 84 in surface contact with a heat transfer tube 60, and a sheet portion 85 forming the collar 84, and particularly the sheet portion 85 corresponds to a flat portion.

Louvers 83*a* and 83*d* are formed in the inclined portions 82*a* and 82*d* positioned on the outside among inclined portions 82*a*, 82*b*, 82*c*, and 82*d*.

In FIG. 11, the louvers 83*a* and 83*d* are formed in the inclined portions 82*a* and 82*d* positioned on the outside among the inclined portions 82*a*, 82*b*, 82*c*, and 82*d*, but are not limited thereto. Although not shown drawings, louvers 83*a* and 83*d* may be formed in the inclined portions 82*b* and 82*c* positioned on the inside among the inclined portions 82*a*, 82*b*, 82*c*, and 82*d*.

The corrugated fin 80 includes four inclined portions 82*a*, 82*b*, 82*c*, and 82*d*, but is not limited thereto, and the corrugated fin 80 may include two, three, or five or more inclined portions.

In addition, in FIG. 4, the sheet portion 85 is formed in the oval type shape, but is not limited thereto. It is also possible for the sheet portion to be formed in an oval shape.

In this case, it is appropriate that the two focal points of the sheet portion 85 having the oval shape are symmetrically positioned in the first direction with respect to the center O of the heat transfer tube 60, but is not limited thereto.

As is apparent from the above description, the heat exchanger and the air condition including the same may have the improved heat exchange performance because the flat portion formed around the heat transfer tube has the first length in the first direction corresponding to the air flow direction and the second length, which is less than the first length, in the second direction perpendicular the air flow direction and thus it is possible to allow the flat portion to be in contact with larger amount of air.

Although a few embodiments of the disclosure have been shown and described, it would be appreciated by those skilled in the art that changes may be made in these embodiments without departing from the principles and spirit of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A heat exchanger comprising:

a heat transfer tube configured to guide a refrigerant; and a plurality of corrugated fins provided with a through hole through which the heat transfer tube is installed to pass, the plurality of corrugated fins spaced apart from each other to allow air to pass in a first direction, wherein each of the plurality of the corrugated fins comprises:

a corrugated portion formed in a zigzag shape in the first direction corresponding to an air flow direction;

a flat portion provided as a flat surface in a vicinity of the through hole; and a connecting portion configured to connect the corrugated portion to the flat portion, wherein the flat portion has a first length in the first direction corresponding to the air flow direction, and a second length shorter than the first length, in a second direction perpendicular to the air flow direction, wherein the flat portion is formed by a first arc passing through a first point corresponding to one end of the first direction, a second arc passing through a second point corresponding to the other end of the first direction, a third arc passing through a third point corresponding to one end of the second direction, a fourth arc passing through a fourth point corresponding to the other end of the second direction, and tangent straight lines connecting the first arc to the second arc, the second arc to the third arc, the third arc to the fourth arc, and the fourth arc to the first arc, wherein the corrugated portion further comprises two ridges and one valley formed on four inclined portions, wherein a center of the heat transfer tube is placed at a position corresponding to the valley, and the flat portion corresponding to the center of the heat transfer tube is directly connected to the valley, and wherein the connecting portion is provided to surround a perimeter area of the flat portion except the valley.

2. The heat exchanger of claim 1, wherein each of the plurality of the corrugated fins further comprises a collar in surface contact with the heat transfer tube and a sheet portion provided in the vicinity of the through hole so as to form the collar, wherein the sheet portion forms the flat portion.

3. The heat exchanger of claim 1, wherein a center of curvature of the first arc and a center of curvature of the second arc are symmetrically positioned in the first direction with respect to a center of the heat transfer tube.

4. The heat exchanger of claim 1, wherein a center of curvature of the third arc and a center of curvature of the fourth arc are symmetrically positioned in the second direction with respect to a center of the heat transfer tube.

5. The heat exchanger of claim 1, wherein:

the first arc and the second arc have a first radius of curvature, and the third arc and the fourth arc have a second radius of curvature greater than the first radius of curvature.

6. The heat exchanger of claim 1, wherein a ratio of the first length of the flat portion to the second length of the flat portion is in a range from about 0.6 to about 0.85.

* * * * *